US006111209A

United States Patent [19]

Dzurnak

[11] Patent Number: 6,111,209

[45] Date of Patent: Aug. 29, 2000

[54] ELECTRICAL COMBINATION SWITCH

[75] Inventor: Stanislav Dzurnak, Oberschleissheim, Germany

[73] Assignee: Bayerische Motoren Werke Aktiengesellschaft, Munich, Germany

[21] Appl. No.: 09/345,760

[22] Filed: Jul. 1, 1999

[30] Foreign Application Priority Data

Aug. 11, 1998 [DE] Germany ..... 198 36 298

[51] Int. Cl.[7] ..... H01H 1/20

[52] U.S. Cl. ..... 200/50.32; 200/50.35

[58] Field of Search ..... 200/401, 438, 200/439, 553, 557, 408, 409, 6 R, 563, 252, 339, 317, 50.35, 43.16, 43.01, 43.14, 50.33, 50.32

[56] References Cited

U.S. PATENT DOCUMENTS

| | | | |
|---|---|---|---|
| 3,674,953 | 7/1972 | Brevick | 200/77 |
| 3,908,108 | 9/1975 | Hults . | |
| 4,213,513 | 7/1980 | Beck . | |
| 4,508,944 | 4/1985 | Yashima et al. . | |
| 4,570,078 | 2/1986 | Yashima et al. . | |
| 4,910,365 | 3/1990 | Kuo | 200/43.16 |

FOREIGN PATENT DOCUMENTS

| | | |
|---|---|---|
| 0 046 480 | 3/1982 | European Pat. Off. . |
| 0 050 085 | 4/1982 | European Pat. Off. . |

*Primary Examiner*—Michael L. Gellner
*Assistant Examiner*—Nhung Nguyen
*Attorney, Agent, or Firm*—Evenson, McKeown, Edwards & Lenahan, P.L.L.C.

[57] ABSTRACT

An electrical switch combination, especially for controlling a cruise control of a motorcycle, has a first electrical toggle switch that can be pivoted from a middle position into two toggle positions, and which automatically returns to the middle position, and an additional electrical slide switch which can assume at least two different switch positions. Th slide switch is mutually linked with the first switch in such fashion that its actuating member mechanically blocks the actuating member of the toggle switch in its middle position in at least one switch position.

7 Claims, 1 Drawing Sheet

ELECTRICAL COMBINATION SWITCH

BACKGROUND AND SUMMARY OF THE INVENTION

This application claims the priority of German Application No. 198 36 298.6, filed Aug. 11, 1998, the disclosure of which is expressly incorporated by reference herein.

The invention relates to a combination electrical toggle and additional electrical switch, especially for controlling a motorcycle cruise control system.

A switch combination is known, especially for controlling a cruise control on a motorcycle, consisting of an electrical toggle switch that can be pivoted from a middle position into two toggle positions and which returns automatically to the middle position, and an additional electrical switch that can assume two different switch positions. A switch combination of this kind is used for controlling a cruise control on the motorcycles of the Ultra Classic E Glide motorcycle manufactured by Harley-Davidson. The additional switch is an ON/OFF switch having two switch positions, designed for example as a toggle switch. It turns the cruise control function on and off. The electrical toggle switch, which can be pivoted from its middle position into two toggle positions and returns automatically to the middle position, serves to control the individual functions of the cruise control. If the electrical toggle switch is in its middle position, the status quo is maintained. This means either that a certain previously set speed is maintained, or the cruise control is nonoperational. The latter condition exists when the cruise control function has been switched off by operating the hand grip throttle, the brake, or the clutch of the vehicle. However, in order to achieve one of these two operating states on the cruise control, the cruise control must be actuated by switching on an additional electrical switch. If the additional electrical switch is set to OFF, no cruise control function may be selected and the speed of the motorcycle is controlled exclusively by the hand grip throttle and the brake.

In a cruise control switch that has been switched on by the additional electrical switch, the current speed is stored as the set speed by moving the electrical toggle switch out of its middle position into one end position. By holding the switch in this end position for a period of time, the vehicle is accelerated continuously. Pivoting the electrical toggle switch into the other end position decelerates the vehicle continuously or sets a stored set speed value that was disabled for a certain period of time, for example by turning the hand grip throttle, to resume functioning.

The two switches for controlling the cruise control cannot be recognized visually as a unit, and therefore the operation of the cruise control requires an increased level of attention and awareness from the driver. Thus for example, when the electrical toggle switch is operated, a check must be made first to determine whether the other electrical switch is in the ON position.

The goal of the present invention is to provide an electrical switch combination which is simple to operate and in which, by virtue of the arrangement of the individual switches, their interaction and common function is immediately apparent without any further effort.

The goal is achieved according to the invention by a switch combination, especially for controlling a cruise control of a motorcycle, with an electrical toggle switch that can be pivoted from a middle position into two toggle positions and which returns automatically to the middle position, and with an additional electrical switch that can assume at least two different switch positions. The additional electrical switch is a slide switch whose additional actuating member is in a mutual relationship with the actuating member of the toggle switch, with the additional actuating member of the slide switch in at least one switch position mechanically blocking the actuating member of the toggle switch in its middle position. Additional embodiments of the invention are described herein.

According to the invention, an electrical switch combination composed of an electrical toggle switch that can be pivoted out of a middle position into two toggle positions and returns automatically to the middle position, and of an additional electrical switch, which can assume at least two different switch positions, is characterized in that the additional electrical switch is a slide switch whose additional actuating member is mutually linked with the actuating member of the toggle switch, with the additional actuating member of the slide switch, in at least one switch position, mechanically blocking the actuating member of the toggle switch in its middle position.

This has the advantage that the interaction between the two electrical switches and their common function can be recognized visually at once. In addition, if the slide switch is used as an ON/OFF switch, a different electrical circuit wiring is provided for the toggle switch, since the toggle switch is blocked mechanically by the slide switch and so its actuation is already limited.

In an advantageous embodiment of the invention, the directions of movement of the actuating member and the additional actuating member are perpendicular to one another. Further, the additional actuating member of the slide switch, in one of two switch positions, fits around the actuating member of the toggle switch in its middle position, at least partially shapewise.

This switch combination is especially favorable for controlling a cruise control system. The electrical slide switch, in one of its positions, blocks the toggle switch via its shape, with the slide switch being in its OFF position. Thus, the cruise control which has been switched off is immediately evident to the viewer and at the same time, its adjusting elements are blocked mechanically.

In another advantageous embodiment of the invention, a pilot light is provided that is covered by the additional actuating member of the slide switch in one of its switch positions.

A pilot light that indicates the switched-on state by its illumination is advantageously located so that it is covered by the slide switch in the OFF position. As a result, additional visual evidence is provided that the slide switch is set to OFF. In addition, this produces a compact switch unit with a pilot light, which can be very conveniently mounted in the area gripped by a motorcycle rider on the handle bars.

A schematic diagram and two preferred embodiments of the invention are shown herein.

Other objects, advantages and novel features of the present invention will become apparent from the following detailed description of the invention when considered in conjunction with the accompanying drawings.

DETAILED DESCRIPTION OF THE DRAWINGS

Each figure shows the respective switch combination in the two different switch positions ON and OFF.

Figure 1A:
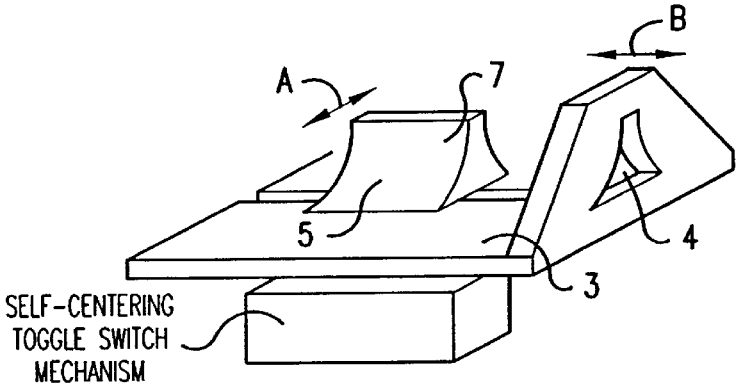
FIGS. 1A and 1B are schematic diagrams of a switch combination according to the invention in which the cooperation of the actuating members is clearly shown.
Figure 1B:
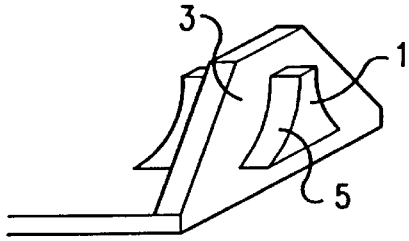
Figure 2A:
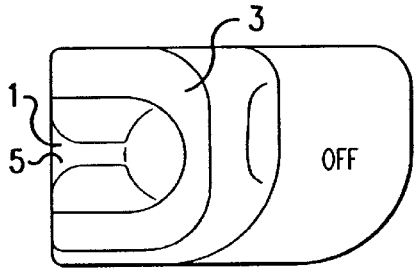
FIGS. 2A and 2B are schematic diagrams of a switch combination according to the invention for controlling a cruise control of a motorcycle.
Figure 3A:
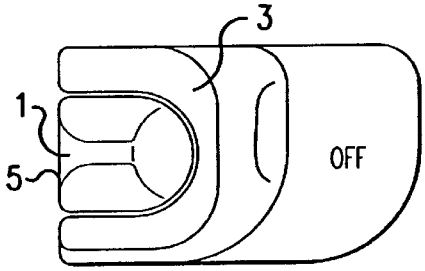
FIGS. 3A and 3B are schematic diagrams of another embodiment of a switch combination corresponding to FIG. 2.

In FIGS. 1 to 3, the actuating members are shown exclusively for an electrical switch combination. The function of the electrical switches is itself not the subject of the invention and is therefore not shown or described in any greater detail than that shown in FIGS. 1–3. Suffice it to say that as far as the design of these switches and their electrical function is concerned, they could readily be constructed by an individual skilled in the art using known electrical switching devices.

Figure 2B:
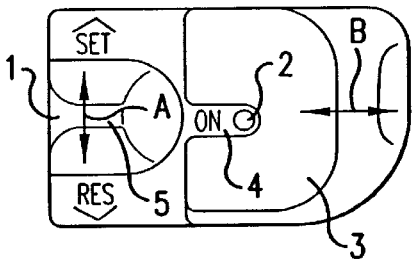
Figure 3B:
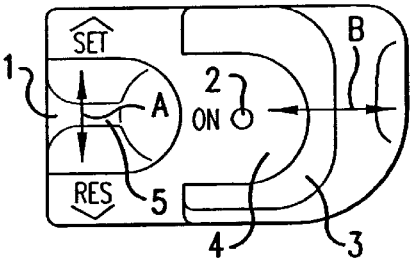

FIGS. 1, 2, and 3 show an actuating member 1 of an electrical toggle switch that can be pivoted (per movements of arrow A) from a middle position as shown into two toggle positions. The toggle directions are indicated in FIGS. 2B and 3B by the switch labels for the SET and RES functions that are conventional for controlling a cruise control system. When the actuating member 1 of the toggle switch is briefly pivoted upward in the SET direction, a new speed setpoint is selected. If the switch is held in this pivot position for a period of time, the vehicle accelerates continuously up to a speed value that is then stored when the actuating member 1 is released and therefore automatically returns to its middle position.

When the actuating member 1 of the electrical toggle switch is moved in the direction of the label RES, a stored speed setpoint is used, namely the one that was set prior to the actuation of the brake, hand grip throttle or clutch of the motorcycle that switches off the cruise control function. If the actuating member 1 is held in the RES position for a period of time, the vehicle decelerates continuously to a speed setpoint that corresponds to the speed when actuating member 1 is released. The actuating member 1 automatically returns to the middle position shown in the Figures.

A pilot light 2 and the label ON also indicate that the cruise control function is switched on.

As an additional electrical switch, a slide switch is used which moves (per arrow B) from a position in which the cruise control function is switched on perpendicularly to the toggling direction (arrow A) of motion of actuating member 1. When moved, an additional actuating member 3 of the slide switch engages with a projection on actuating member 1 of the electrical toggle switch. As a result, actuating member 1 is engaged partially shapewise by the additional actuating member 3.

Actuating member 1 of the electrical toggle switch can thus no longer be moved upward or downward; it is locked in its middle position. The pilot light 2 and the label ON are covered by the additional actuating member 3 of the slide switch. In addition, the label OFF (FIGS. 2A, 3A) is exposed by the additional actuating member 3 of the slide switch. This switch is located in its end position in which the cruise control system is switched off, in other words the cruise control system cannot be actuated. This is also clearly indicated visually by the fact that the actuating member 1 of the electrical toggle switch is blocked by the additional actuating member 3 of the slide switch and is prevented from moving.

Of course, while FIGS. 1–3 illustrate particular shapewise couplings between the additional electrical switch and the toggle switch, it will readily be understood that any visually identifiable mechanical coupling can be used to prevent the actuation of the toggle switch when the cruise control system is in the OFF position.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A combination switch, comprising:

an electrical toggle switch pivotable from a middle position into two toggle positions, said toggle switch automatically returning to the middle position when not actuated;

an additional electrical switch which assumes at least two different switch positions;

wherein the addition al electrical switch is a slide switch having an additional actuating member in a mutual relationship with an actuating member of the toggle switch, such that the additional actuating member of the slide switch mechanically blocks the actuating member of the toggle switch when in the middle position in at least one switch position.

2. The combination switch according to claim 1, wherein directions of movement of the actuating member of the toggle switch and the additional actuating member of the slide switch are perpendicular to one another, and further wherein the additional actuating member of the slide switch, in one of two switch positions, at least partially fits around the actuating member of the toggle switch in the middle position.

3. The combination switch according to claim 1, further comprising a pilot light, said pilot light being covered by the additional actuating member of the slide switch in one of the switch positions.

4. The combination switch according to claim 2, further comprising a pilot light, said pilot light being covered by the additional actuating member of the slide switch in one of the switch positions.

5. A combination switch, comprising:

a toggle switch pivotable from a mid position into two toggle positions via a toggle actuating member;

a slide switch slidably movable into at least two different switch positions via a slide actuating member;

wherein in at least one of said two different switch positions, the slide actuating member mechanically blocks toggle movements of the toggle actuating member.

6. The combination switch according to claim 5, wherein said slide actuating member has a defined shape which fits at least partially around the toggle actuating member in its mid position to block the toggle movements.

7. The combination switch according to claim 6, wherein the toggle movements and slide movements are perpendicular to one another.

* * * * *